United States Patent [19]

Papov

[11] Patent Number: 4,819,354

[45] Date of Patent: Apr. 11, 1989

[54] ONE-PIECE FOLDABLE FRAME ASSEMBLY

[76] Inventor: Zelko Papov, 2825 Islington Ave. N., Weston, Canada, M9L 2K1

[21] Appl. No.: 44,291

[22] Filed: Apr. 30, 1987

[51] Int. Cl.[4] ..... G09F 1/12

[52] U.S. Cl. ..... 40/154; 40/152.1; 248/459

[58] Field of Search ..... 40/154, 155, 124.1, 40/152.1; 206/40.24, 40.25; 248/459

[56] References Cited

U.S. PATENT DOCUMENTS

| | | | |
|---|---|---|---|
| 723,696 | 3/1903 | Maine | 40/154 |
| 1,421,448 | 7/1922 | Fritz | 40/154 |
| 3,357,671 | 12/1967 | Ketterer | 40/124.1 |
| 3,473,777 | 10/1969 | Ketterer | 40/152.1 X |
| 4,149,630 | 4/1979 | Transport | 40/124.1 X |
| 4,379,373 | 4/1983 | Transport | 40/152.1 |

*Primary Examiner*—Leonard E. Smith

*Attorney, Agent, or Firm*—Riches, McKenzie & Herbert

[57] ABSTRACT

A one-piece, picture frame and a picture frame assembly are disclosed. The picture frame is made from a suitably-foldable material and has a front piece having at least one viewing opening therethrough, edge pieces and back pieces which fold into a front piece, side faces and back faces to frame an object to be framed. An open channel is formed between the respective front face and the back pieces into which the respective edges of the material to be framed can be inserted to position and hold the material to be framed within the picture frame. The picture frame together with the material to be framed form a frame assembly. The back pieces of the picture frame can adhere to the bottom surface of the material to be framed. In further embodiments of the invention, the picture frame includes a backing member and a supporting member to support the picture frame when it is positioned on such things as a table top. The invention is useful for framing such items as pictures, photographs and postcards, especially when the object to be framed is sandwiched between a viewing sheet and a backing sheet.

19 Claims, 6 Drawing Sheets

ONE-PIECE FOLDABLE FRAME ASSEMBLY

BACKGROUND OF THE INVENTION

This invention relates to a picture frame and a picture frame assembly, in particular, a one-piece picture frame made from a suitably-foldable material for framing material to be framed wherein the material to be framed comprises at least one flat, planar object.

In the past, there have been many foldable frames made from foldable material. However, many of those frames had pictures pre-printed on the front surface of the back piece of the frame, or had the object to be framed adhered to the front surface of the back piece of the picture frame.

Moreover, the prior art picture frames were either too simple in that they did not provide a suitable frame into which the material to be framed could be inserted. Rather, the material to be framed was merely placed on the frame and attached to the frame. Such frames were not suitable for framing combined material comprising the object to be framed, such as a picture, photograph or postcard, plus a suitable viewing sheet over the object to be framed through which the object to be framed could be viewed, a suitable backing material and perhaps even matting.

On the other hand, other of the prior art picture frames were too complicated to be easily and cheaply manufactured and to be readily used. This is because many of these prior art picture frames utilized a plurality of intricate tabs and tab receiving areas. As a consequence, the picture frame required too many cuts, folds and insertions.

Also, none of the prior art provided a suitable frame incorporating as part of the frame a supporting means to support the frame on, for example, a desk top.

SUMMARY OF THE INVENTION

Accordingly, it is an object of this invention to overcome at least some of the disadvantages of the prior art by providing an inexpensive, easily manufactured and easily-foldable alternative picture frame to the prior art picture frames.

Accordingly, in one of its broad aspects, this invention resides in a one-piece, picture frame made from suitably-foldable material, for framing material to be framed which comprises at least one flat, planar object to be framed, comprising: a front piece having a plurality of sides and having at least one viewing opening therethrough; an edge piece foldably extending from each respective side of the front piece; a back piece foldably extending from each respective edge piece, wherein each back piece has a back edge; wherein the frame is foldable around the material to be framed such that: the edge pieces form side faces extending in the same direction and substantially at right angles to the front piece; the back pieces form back faces extending inwardly from the respective side faces; an open channel is formed between each back face and the front piece; the depth of each channel is substantially the same as the depth of the material to be framed; and the material to be framed is positioned within the frame by positioning a respective outer edge of the material to be framed within the respective channel.

Accordingly, in another of this broad aspect, this invention resides in providing a picture frame as described above but further comprising a backing member and a supporting member foldably extending as a part of the frame from one of the back pieces of the frame.

Accordingly, in another of its broad aspects, this invention resides in providing a picture frame assembly comprising: (a) material to be framed, comprising at least one flat, planar object to be framed; suitable viewing sheet over the object to be framed; and suitable backing material under the object to be framed comprising a first and a second backing sheet; and (b) a one-piece picture frame made from suitably-foldable material, comprising: a front piece having a plurality of sides and having at least one viewing opening therethrough; an edge piece foldably extending from each respective side of the front piece; a back piece foldably extending from each respective edge piece, wherein each back piece has a back edge; a backing member having a first part and a second part, each part having a first edge and a second edge; and a supporting member comprising a plurality of adjacent, foldably-connected parts, and having a first edge and a second edge; wherein the first part of the backing member is foldably connected at the first edge thereof to one back piece at the back edge thereof; a first part of the supporting member is foldably connected at the first edge of the supporting member to the first part of the backing member, at the second edge thereof; a second part of the supporting member is foldably connected at the second edge of supporting member to the second part of the backing member at the first edge thereof; wherein each of the parts of the supporting member has a bottom edge, and the bottom edge of at least one of the parts of the supporting member is formed so as to provide at least one support point for supporting the picture frame; wherein the frame is folded around the material to be framed such that: the edge pieces form side faces extending in the same direction and substantially at right angles to the front piece; the back pieces form back faces extending inwardly from the respective side faces; an open channel is formed between each back face and the front piece; the depth of each channel is substantially the same as the depth of the material to be framed; the material to be framed is positioned within the frame by positioning a respective outer edge of the material to be framed within the respective channel; the first and second edges of the supporting member are proximate each other such that the supporting member is generally normal to the backing member; the viewing sheet is within the respective channels; the first backing sheet adhered to the first and second parts of the backing member; and the second backing sheet is positioned within the respective channels and adjacent to the back pieces, and has an opening for receiving the first backing sheet.

Further aspects of the invention will become apparent upon reading of the following detailed description and the drawings which illustrate the invention and embodiments of the invention.

DETAIL DESCRIPTION OF THE INVENTION AND PREFERRED EMBODIMENTS THEREOF

The picture frame of this invention is a one-piece frame that is made from any suitably-foldable material. Preferred material is corrugated cardboard, cardboard, Bristol board or heavy paper.

The picture frame assembly of this invention comprises the picture frame of the invention in assembly with the material to be framed.

Figure 1:
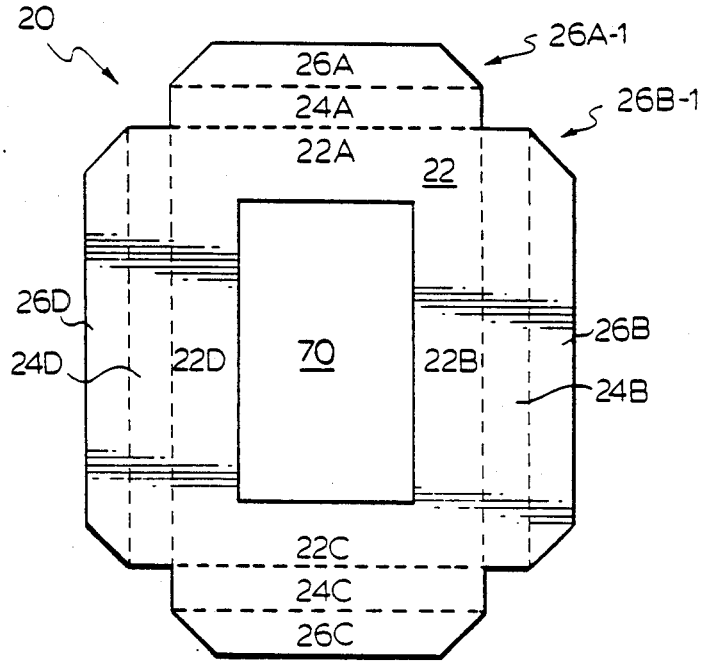
FIG. 1 is a schematic, front view of an embodiment of the picture frame of this invention in its unfolded state.

With reference to FIG. 1, a preferred embodiment of the picture frame 20 can be seen in its pre-assemblied or pre-folded state. The dimensions illustrated in FIG. 1, and all other figures, are not the actual dimensions but are shown only for the purposes of illustration.

The picture frame 20 comprises a front piece 22 which has a plurality of sides, as required for any particular framing application. Preferred numbers of sides include three, five, six, eight, ten or twelve sides. However, the most preferred number of sides is four as shown in FIG. 1. In FIG. 1, there are sides 22A, 22B, 22C and 22D.

The front piece 20 has a viewing opening 70 through the front face 20. The viewing opening 70 is for exposing to view the object to be framed. The viewing opening can be of any desired shape or size that fits within the front face 22. Preferable viewing openings are circular, oval, square or rectangular. There can be more than one viewing opening so as to provide exposure to view of more than one place in the front face 20.

Edge pieces 24A, 24B, 24C and 24D extend from the respective sides of the front piece 22.

Back pieces 26A, 26B, 26C and 26D extend from the respective edge pieces 24.

In order to construct the frame 20, a piece of the suitably-foldable material is cut, either by hand or by any suitable automated means such as a stamp, into the general shape shown in FIG. 1. The cut picture frame 20 is then folded along the dotted lines shown in FIG. 1. Preferably, the frame 20 is scored along the dotted lines before folding.

In order to put the frame 20 into its folded state, the edge pieces 24 are folded downwardly from the front piece 22 at substantially right angles to the back piece 22 to form side faces 24. All side pieces 24 are folded in the same direction.

Figure 2:
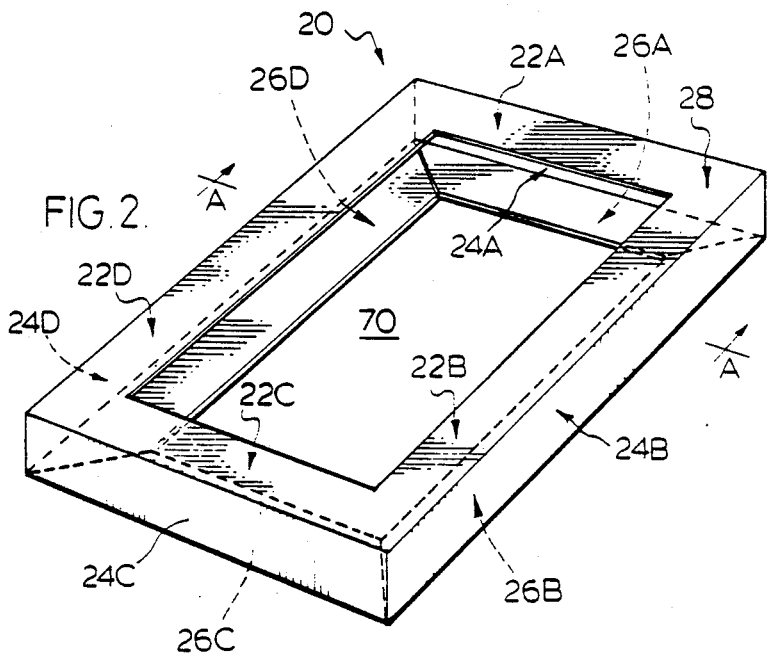
FIG. 2 is a schematic perspective view of an embodiment of the picture of this invention in its folded state.

The back pieces 26 are all folded inwardly from the side faces 24 to form back faces 26. Preferably, but not necessarily, each side edge (for example 26A-1 in FIG. 2) of each back piece (for example 26A) abuts against the adjacent side edge (26B-1) of the adjacent back piece 26B. Preferably, the abutment is as shown in FIG. 2 at 28, that is, for a four-sided back piece 22, the respective side edges 26A-1 and 26B-1 are cut at a 45° angle.

In order that the side edges 26A-1 and 26B-1 abut in this fashion, it is necessary that the respective back pieces 26A and 26B have similar shapes. Conversely, so long as the side edges of the back faces 26 are abutted rather than overlapped, the provision of similar shapes for the front pieces 26 will permit such an aesthetic appearance.

Figure 6:
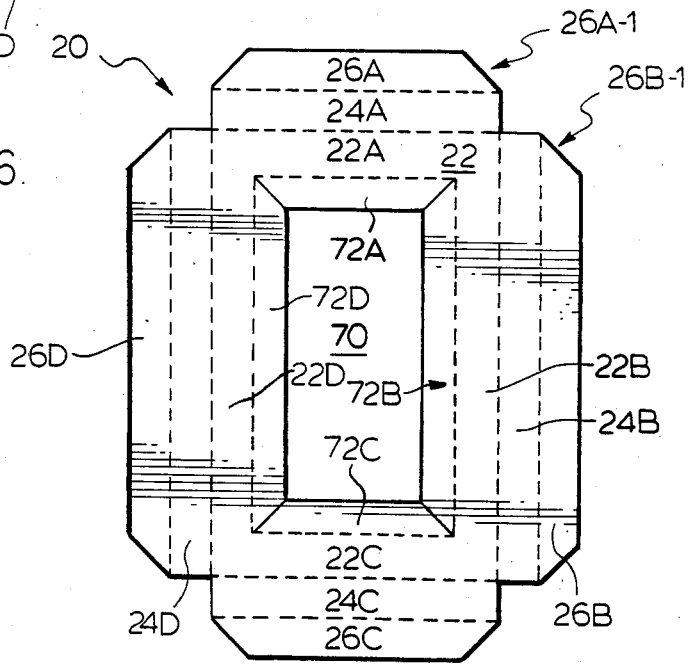
FIG. 6 is schematic, front view of a further embodiment of the picture frame of this invention in its unfolded state.

For a more aesthetically pleasing front face 22, as best seen in FIG. 6, when the viewing opening is in the shape of a polygon, such as a rectangle, as defined by the edges of the viewing opening, extending from those edges of the viewing opening can be underturn pieces 72. The underturn pieces 72 can be turned or folded under the front piece 22 during assembly. This provides a folded edge to be exposed to view in the front area of the frame 20, rather than simply a cut edge.

Figure 3:
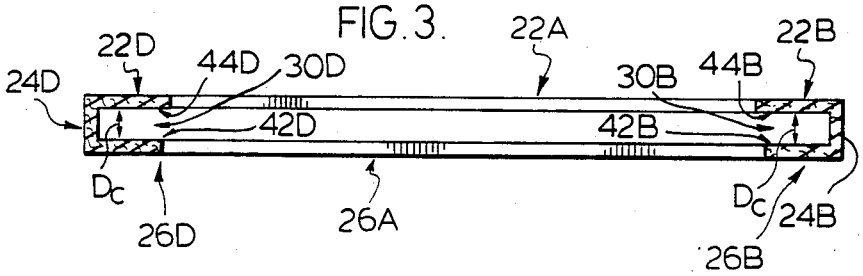
FIG. 3 is a cross-sectional view along the line A—A in FIG. 2.

A feature of this invention is that open channels 30 are formed between each respective back face 26 and the front piece 22. This is best seen in FIG. 3.

When in use, the channels 30 are used to hold the material to be framed in the proper position within the frame 20. By reference to FIG. 4, it can be seen that the edge 32D of the material to be framed 34 has been inserted within the channel 30D.

Figure 4:
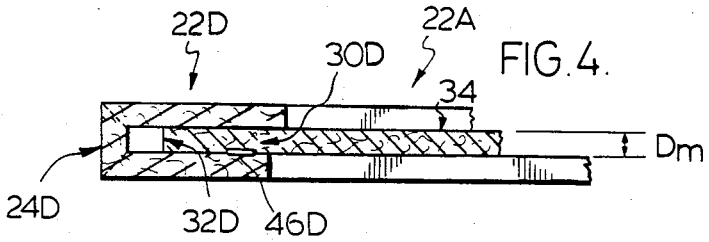
FIG. 4 is a partial cross-sectional view of the picture frame in its folded state and of the picture frame assembly of the invention.

In FIG. 4, the material to be framed 34 is a single, flat, planar object. Usually, the object to be framed would be, one or more of, a picture, photograph, postcard or whatever the user desired.

Figure 5:
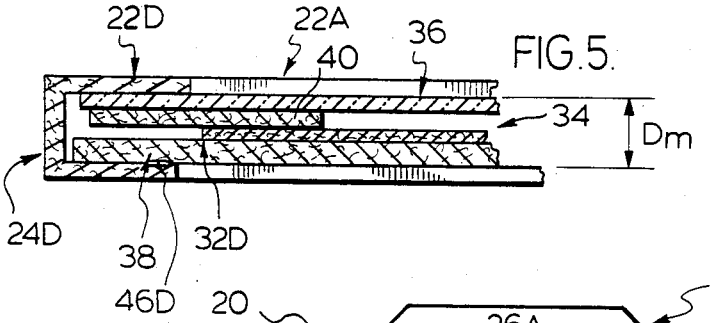
FIG. 5 is a partial cross-sectional view of the picture frame in its folded state and of the picture frame assembly of the invention.

In FIG. 5, the material to be framed comprises the object to be framed (picture, photograph, postcard or similar object) plus a suitable viewing sheet 36, such as a glass or plastic plate, which is placed over the object to be framed 34 so as to allow a viewer to view the object to be framed but at the same time protect the object to be framed from possible damage. Also shown in FIG. 5 is a suitable backing sheet or backing material 38 which can be cardboard, corrugated cardboard, felt or other suitable material.

Also shown in FIG. 5 is a matting 40.

It will be noted that the edges of the various object to be framed 34, viewing sheet 36, backing sheet 38 and matting 40 need not, but may, extend all the way into the respective channels 30 so as to abut against the respective edge piece 24. Also, in the embodiment shown in FIG. 5, where there is some material above the object to be framed 34 such as a viewing sheet 36, it is not necessary that the edges 32 of the object to be framed 34 be within the respective channels 30. All that is necessary is that the respective outer edges 32 of the combined material to be framed be within the respective channel 30. The combined material to be framed should be taken to mean the object to be framed by itself or with any of the various materials noted above, namely viewing sheet 36, backing sheet 38 and matting 40. Preferably the backing material 38 should extend into the channels 30 at least as far as any other of the materials so as to provide a suitable support within the channels 30.

The depth of each of the channels 30 should be taken to mean the distance from the bottom face 44 of the front piece 22 to the upper faces 42 of the back faces 26 (shown as Dc in FIG. 3). Preferably, the depth, Dc, of the channels 30, is substantially the same as the depth of the material to be framed as shown as Dm in FIGS. 4 and 5.

When the depths, Dc, of the channels 30 are substantially the same as the depth of the material to be framed, Dm, the material to be framed can be more readily secured within the frame 20.

Preferably, each of the back faces 26 of the frame 20 is substantially parallel to the front piece 22 when the frame 20 has been folded and is readly for use or is in use.

In order to keep the frame 20 in its folded position (FIG. 2), the material to be framed, whether it is simply the object to be framed 34 or any combination of the object to be framed 34 and a viewing sheet 36, backing sheet 38 and matting 40 is positioned within the frame 20 and the frame 20 is appropriately folded around the material to be framed. The upper face 42 of the back pieces 26 are then adhered to the lower face of the material to be framed as generally shown at 46D on FIGS. 4 and 5. The back pieces 26 can be adhered by any suitable means, for example, sticky tape, glue or adhesive. The suitable means 46 can be pre-applied to the back pieces 26 before use by the person who uses the frame 20 as a frame, or the suitable means 46 can be applied during the framing operation itself.

If the front face 22 has under pieces 72, the channels 30 are created between the under pieces 72 and the back pieces 26. Accordingly, the depth, Dc, of the channels 30 should be measured from the lower face of the respective under pieces 72 to the top face 42 of the respective back pieces 26.

Figure 7:
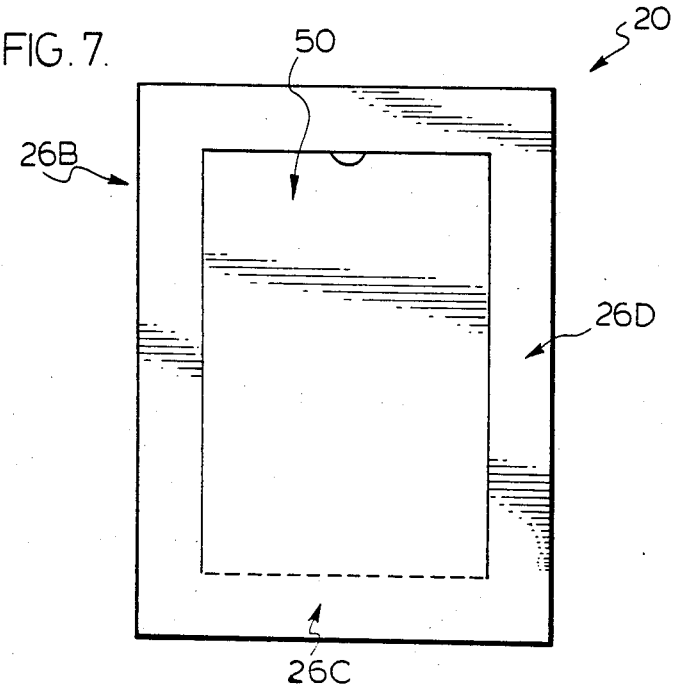
FIG. 7 is a schematic back view of an embodiment of the picture frame of this invention in its folded state.

In a further embodiment, if the material to be framed includes backing material, the backing material can be cut so as to form a flap 50 as shown in FIG. 7. Flap 50 can be opened by turning it back so as to permit insertion and withdrawal of the object to be framed 34 within the picture frame 20.

In order to obtain a particularly pleasing finished frame 20, it is possible to wrap the frame 20 with decorative paper so that the exposed faces of the frame 20 have a pleasing appearance.

The invention is particularly useful when it is used in combination with an object to be framed 34, a suitable viewing sheet 36 and a suitable backing sheet 38.

Figure 8:
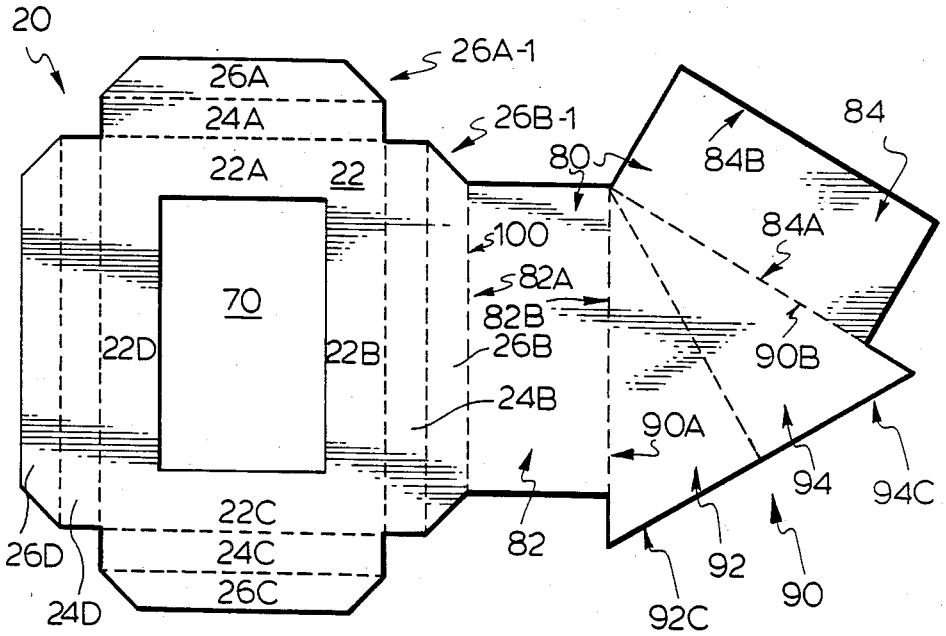
FIG. 8 is a schematic front view of an embodiment of the picture frame in its unfolded state.
Figure 9:
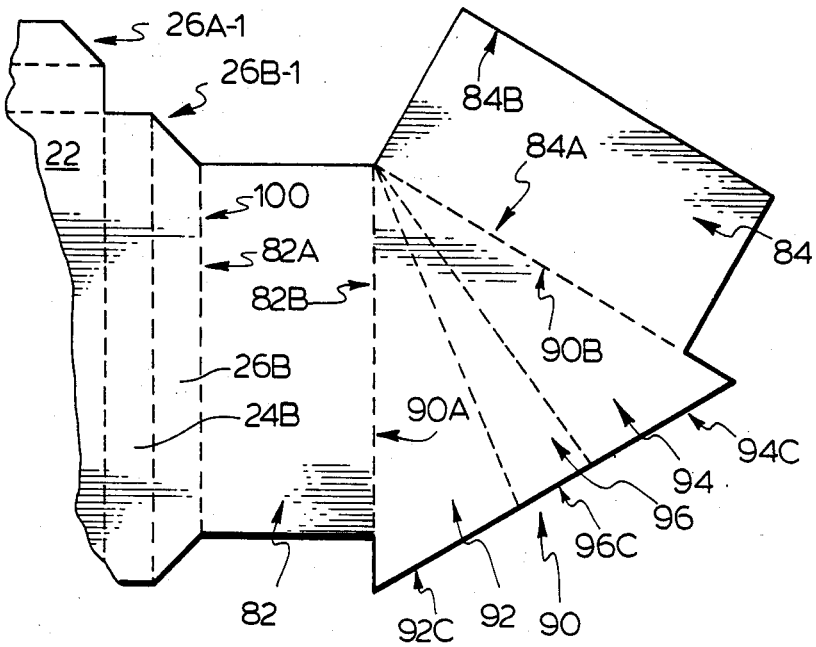
FIG. 9 is a partial front view of an embodiment of the picture frame in its unfolded state.

In a further preferred embodiment of the invention as best shown in FIG. 8, the frame 20 also comprises a backing member 80 having a first part 82 and a second part 84, each part 82, 84 having a first edge 82A, 84A and a second edge 82B, 84B. The frame 20 also comprises a supporting member 90 having a plurality of adjacent, foldably-connected parts. The supporting member 90 has a first edge 90A and a second edge 90B. Preferably, the supporting member 90 has two parts 92, 94 as best seen in FIG. 8 or three parts 92, 96 and 94 as best seen in FIG. 9.

The first part 82 of the backing member 80 is foldably connected at the first edge 82A thereof to one of the back pieces 26 (26B in FIG. 8) at the back edge 100 thereof.

The first part 92 of the supporting member 90 is foldably connected at the first edge 90A of the supporting member 90 to the first part 82 of the backing member 80 at the second edge 82B thereof.

The second part 94 of the supporting member 90 is foldably connected at the second edge 90B of the supporting member 90 to the second part 84 of the backing member 80 at the first edge 84A thereof.

It is possible to have additional parts of the supporting member 90 foldably connected between the first part 92 and second part 94, such as a third part 96 as shown in FIG. 9.

Figure 10:
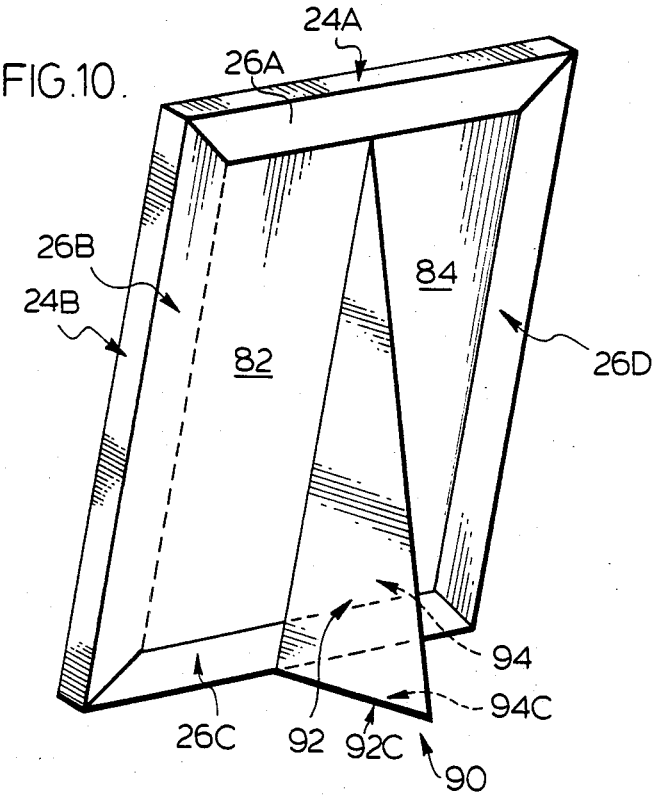
FIG. 10 is a perspective back view of an embodiment of the picture frame assembly.

Each of the parts 92, 94 and 96, and any other parts, of the supporting member 90 has a bottom edge 92C, 94C and 96C. The bottom edge of at least one of the parts 92, 94 and 96 of the supporting member 90 is formed so as to provide at least one support point for supporting the picture frame 20 such as shown in FIG. 10.

In the embodiments illustrated in the Figures, the bottom edges 92C, 94C and 96C of each of the parts 92, 94 and 96 is a whole line of points for supporting the picture frame 20. However, it is possible that only one point on only one of the edges could support the picture frame 20.

The supporting member 90 is used to support the picture frame 20 by folding the various edges such that the first edge 90A and the second edge 90B of the supporting member 90 are brought proximate to each other. Firstly, the edges 90A and 90B may be very close to each other, if there are only two parts, so that the first part 92 and the second part 94 can be touching each other. This results in the supporting member 90 being generally normal to the backing member 80 as generally shown in FIG. 10.

Figure 11:
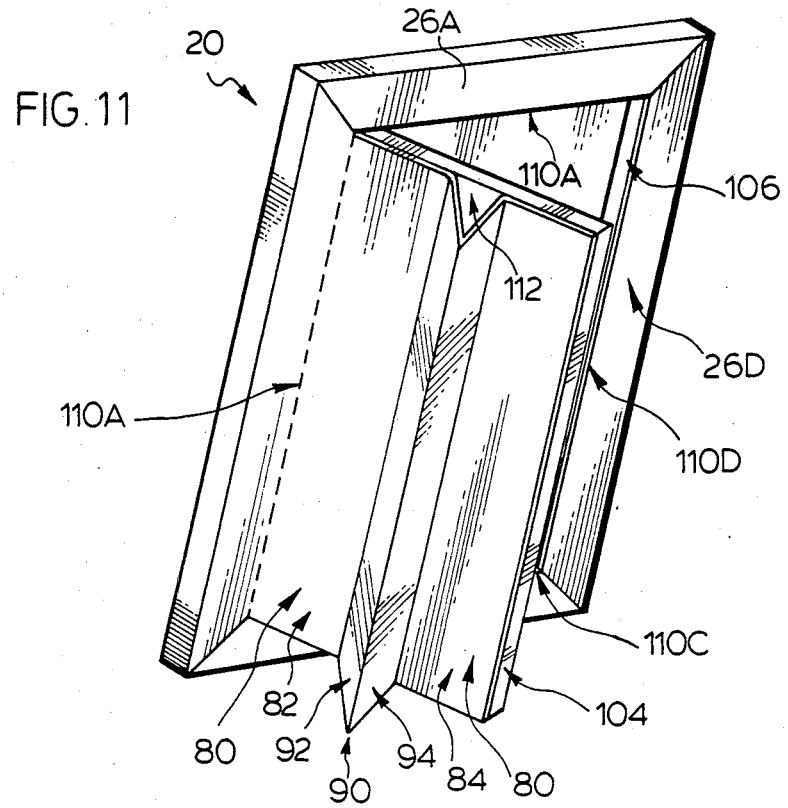
FIG. 11 is a perspective back view of an embodiment of the picture frame assembly.

Secondly, there can be a separation 102 between the edges 90A and 90B (as shown in FIG. 11) so that there is some spacing between the parts 92 and 94. The added spacing helps to provide an additional stability to the supporting member 90 so that there is less chance that the supporting member 90 will be folded back out of its position at right angles to the backing member 80.

Preferably, when the frame 20 is assembled, the first part 82 and the second part 84 of the backing member 80 are adhered, by any suitable means, for example glue, tape or adhesive, to a first backing sheet 104. A second backing sheet 106 is positioned within the respective channels 30 of the frame 20 and adjacent to the back pieces 26. The second backing sheet 106 has an opening for receiving the first backing sheet 104.

Preferably, the size and shape of the opening in the second backing sheet 106 are substantially the same size and shape as those of the first backing sheet 104 so that when the first backing sheet 104 is inserted into the opening in the second backing sheet 106 the first backing sheet 104 (and thereby the backing member 80) will be kept in place by the snug fit. However, it is possible that the size and shape of the first backing sheet 104 are smaller than those of the second backing sheet 106. In this situation however, the first backing sheet 104 is not kept as securely in place.

The first backing sheet 104 is received in the opening in the second backing sheet 106 by pushing the backing member 80 and the first backing sheet 104 into the opening. To remove the first backing sheet 104 from the opening, the user can use the supporting member 90 to pull the first backing sheet 104 away from the opening. Thus, the object to be framed can be replaced by moving the first backing sheet 104 from the opening.

Preferably, the size and shape of the opening in the second backing sheet 106 are substantially the same as the size and shape of the surface defined by the back edges 110 of the back faces 26 (as shown in FIG. 11).

Preferably, the size and shape of the backing member 80 are substantially the same as the size and shape of the first backing sheet 104. In this regard, the size and shape of the backing member 80 should be understood as including the size and shape of any spacing 112 (see FIG. 11) between the first part 82 and the second part 84 of the backing member 80.

The second backing sheet 106 may be adhered, by any suitable means, to the back pieces 26 as generally shown in FIG. 5 at 46D.

Preferably, each of the back pieces 26 lies in a plane that is substantially parallel to the front pieces 22.

The picture frame 20 of the invention can be formed into a picture frame assembly by including with any combination of the embodiments of the picture frame 20 described above, a suitable backing material, whether the first backing sheet 104 and the second backing sheet 106 or a separate backing material, and a suitable viewing sheet over the object to be framed.

In a preferred embodiment, the supporting member 90 is generally triangular in shape (FIGS. 8, 9 and 10) and first part 92 of the supporting member 90 has the same size and shape as the size and shape of a second part 94 of the supporting member 90 and that shape is generally triangular.

In another embodiment, each of the first part 92 and the second part 94 of the supporting member 90 has a first and a second edge 92A, 92B and 94A, 94B, respectively. In one embodiment, the first and second edges of each part 92 and 94 are substantially parallel as typically shown in FIG. 11.

Figure 12:
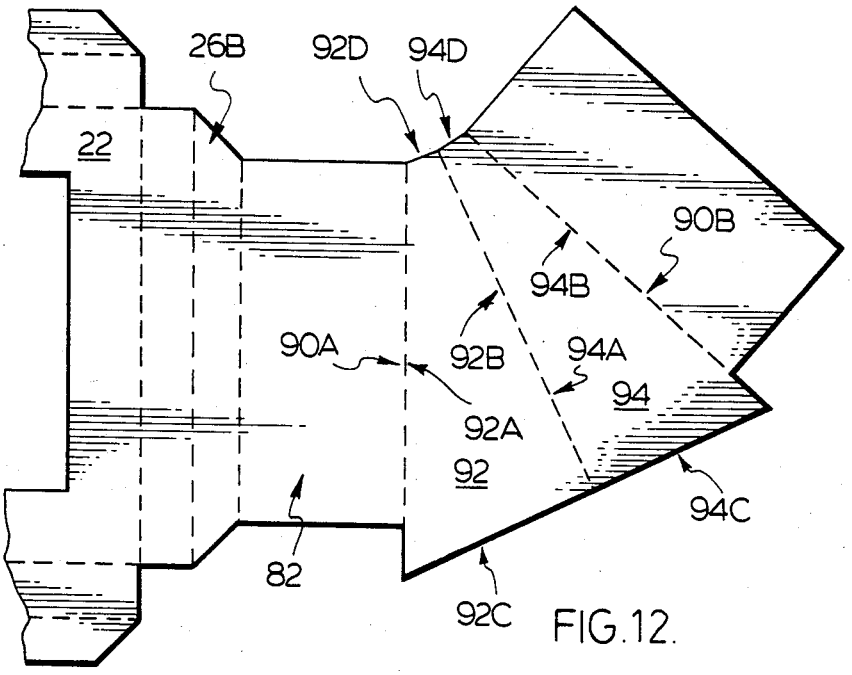
FIG. 12 is a partial front view of an embodiment of the picture frame in its unfolded state.
Figure 13:
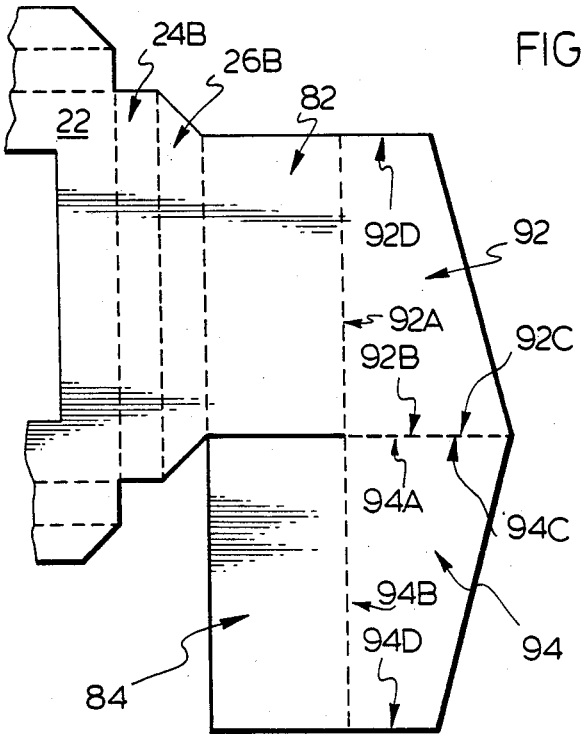
FIG. 13 is a partial, front view of an embodiment of the picture frame in its unfolded state.

In another embodiment, as best shown in FIGS. 12 and 13, each of the first part 92 and the second part 94 of the supporting member 90 are generally quadrilateral in shape. The size and shape of the first part 92 are preferably substantially the same as the size and shape of the second part 94. Also, the bottom edges 92C, 94C of each of the first part 92 and second part 94 are longer than the respective edges 92D, 94D opposite to the bottom edges 92C, 94C.

In a preferred embodiment, the second edge 92B of the first part 92 of the supporting member 90 is the same edge as the first edge 94A of the second part 94 of the supporting member 90. Also, the first and second edges 92A, 92B of the first part 92 are opposite sides of the first part 92 (FIG. 12) and the first and second edges 94A, 94B of the second part 94 are opposite sides of the second part 94 (FIG. 12).

Figure 14:
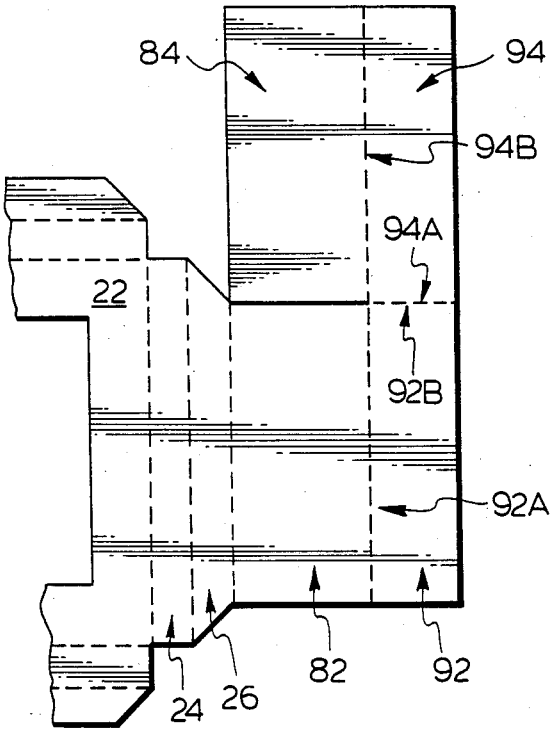
FIG. 14 is a partial, front view of an embodiment of the picture frame in its unfolded state.

In alternative embodiments, the first and second edges 92A, 92B of the first part 92 are adjacent sides of the first part 92 (as typically seen in FIGS. 13 and 14) and the first and second edges 94A, 94B of the second part 94 are adjacent sides of the second part 94 (as typically seen in FIGS. 13 and 14).

As will be apparent to a person skilled in the art, many of the described features of the invention can be included in any particular embodiment so that the particular features can be selected and used in combination depending on the particular application.

Although the disclosure describes and illustrates preferred embodiments of the invention, it is to be understood that the invention is not restricted to these particular embodiments.

What I claim is:

1. A one-piece, picture frame made from suitably-foldable material, for framing material to be framed which comprises at least one flat, planar object to be framed, comprising:

a front piece having a plurality of sides and having at least one viewing opening therethrough;

an edge piece foldably extending from each respective side of the front piece;

a back piece foldably extending from each respective edge piece, wherein each back piece has a back edge;

a backing member having a first part and a second part, each part having a first edge and a second edge; and a supporting member comprising a plurality of adjacent, foldably-connected parts, and having a first edge and a second edge;

wherein the first part of the backing member is foldably connected at the first edge thereof to one back piece at the back edge thereof;

a first part of the supporting member is foldably connected at the first edge of the supporting member to the first part of the backing member at the second edge thereof;

a second part of the supporting member is foldably-connected at the second edge of the supporting member to the second part of the backing member at the first edge thereof;

wherein each of the parts of the supporting member has a bottom edge, and the bottom edge of at least one of the parts of the supporting member is formed so as to provide at least one support point for supporting the picture frame;

wherein the frame is folded such that:

the edge pieces form side faces extending in the same direction and substantially at right angles to the front piece;

the back pieces form back faces extending inwardly from the respective side faces;

an open channel is formed between each back face and the front piece;

the depth of each channel is substantially the same as the depth of the material to be framed; and the first and second edges of the supporting member are proximate each other such that the supporting member is generally normal to the backing member; and further comprising:

a first backing sheet adhered to the first and second parts of the backing member; and a second backing sheet positioned within the respective channels and adjacent to the back pieces, and having an opening for receiving the first backing sheet.

2. A picture frame as defined in claim 1 wherein the first backing sheet and the opening in the second backing sheet each has a size and shape that are substantially the same size and shape as the surface defined by the back edges of the back pieces extending inwardly.

3. A picture frame as defined in claim 2 wherein each of the first and second parts of the supporting member is generally triangular in shape, the shape and size of the first part of the supporting member are substantially the same as the shape and size of the second part of the supporting member, and the supporting member is generally triangular in shape.

4. A picture frame as defined in claim 2 wherein each of the first and second parts of the supporting means has a first edge and a second edge, the first edge of the first part of the supporting means is the first edge of the supporting means and the second edge of the second part of the supporting means is the second edge of the supporting means.

5. A picture frame as defined in claim 4 wherein the first and second edges of the first part of the supporting member are substantially parallel, and the first and second edges of the second part of the supporting member are substantially parallel.

6. A picture frame as defined in claim 4 wherein each of the first and second parts of the supporting member is generally quadrilateral in shape, the shape and size of the first part of the supporting means are substantially the same size and shape as the second part of the supporting means, the bottom edge of each of the first and second parts of the supporting means is longer than the respective edge opposite to the bottom edge.

7. A picture frame as defined in any of claims 3, 4 or 5 wherein the backing member has a size and shape the same as the size and shape of the first backing sheet, and each of the back pieces lies in a plane substantially parallel to the front piece.

8. A picture frame as defined in any of claim 6 wherein the backing member has a size and shape the same as the size and shape of the first backing sheet, and each of the back pieces lies in a plane substantially parallel to the front piece.

9. A picture frame assembly comprising:

(a) material to be framed, comprising at least one flat, planar object to be framed;

suitable viewing sheet over the object to be framed; and suitable backing material under the object to be framed comprising a first and a second backing sheet; and (b) a one-piece picture frame made from suitably-foldable material, comprising:

a front piece having a plurality of sides and having at least one viewing opening therethrough;

an edge piece foldably extending from each respective side of the front piece;

a back piece foldably extending from each respective edge piece, wherein each back piece has a back edge;

a backing member having a first part and a second part, each part having a first edge and a second edge; and a supporting member comprising a plurality of adjacent, foldably-connected parts, and having a first edge and a second edge;

wherein the first part of the backing member is foldably connected at the first edge thereof to one back piece at the back edge thereof;

a first part of the supporting member is foldably connected at the first edge of the supporting member to the first part of the backing member, at the second edge thereof;

a second part of the supporting member is foldably connected at the second edge of supporting member to the second part of the backing member at the first edge thereof;

wherein each of the parts of the supporting member has a bottom edge, and the bottom edge of at least one of the parts of the supporting member is formed so as to provide at least one support point for supporting the picture frame;

wherein the frame is folded around the material to be framed such that:

the edge pieces form side faces extending in the same direction and substantially at right angles to the front piece;

the back pieces form back faces extending inwardly from the respective side faces;

an open channel is formed between each back face and the front piece;

the depth of each channel is substantially the same as the depth of the material to be framed;

the material to be framed is positioned within the frame by positioning a respective outer edge of the material to be framed within the respective channel;

the first and second edges of the supporting member are proximate each other such that the supporting member is generally normal to the backing member;

the viewing sheet is within the respective channels;

the first backing sheet is adhered to the first and second parts of the backing member; and the second backing sheet is positioned within the respective channels and adjacent to the back pieces, and has an opening for receiving the first backing sheet.

10. A picture frame as defined in claim 9 wherein the first backing sheet and the opening in the second backing sheet each has a size and shape that are substantially the same size and shape as the surface defined by the back edges of the back pieces extending inwardly.

11. A picture frame as defined in claim 10 wherein each of the first and second parts of the supporting member is generally triangular in shape, the shape and size of the first part of the supporting member are substantially the same as the shape and size of the second part of the supporting member, and the supporting member is generally triangular in shape.

12. A picture frame as defined in claim 10 wherein each of the first and second parts of the supporting member has a first edge and a second edge, the first edge of the first part of the supporting member is the first edge of the supporting member, and the second edge of the second part of the supporting member is the second edge of the supporting member.

13. A picture frame as defined in claim 12 wherein the first and second edges of the first part of the supporting member are substantially parallel, and the first and second edges of the second part of the supporting member are substantially parallel.

14. A picture frame as defined in claim 12 wherein each of the first and second parts of the supporting member is generally quadrilateral in shape, the shape and size of the first part of the supporting member are substantially the same size and shape as the second part of the supporting member, the bottom edge of each of the first and second parts of the supporting member is longer than the respective edge opposite to the bottom edge.

15. A picture frame as defined in any of claims 11, 12 or 13 wherein the backing member has a size and shape the same as the size and shape of the first backing sheet, and each of the back pieces lies in a plane substantially parallel to the front piece.

16. A picture frame as defined in any of claim 14 wherein the backing member has a size and shape the same as the size and shape of the first backing sheet, and each of the back pieces lies in a plane substantially parallel to the front piece.

17. A one-piece, picture frame made from suitably-foldable material, for framing material to be framed which comprises at least one flat, planar object to be framed, comprising:

a front piece having a plurality of sides and having at least one viewing opening therethrough;

an edge piece foldably extending from each respective side of the front piece;

a back piece foldably extending from each respective edge piece, wherein each back piece has a back edge;

wherein the frame is foldable around the material to be framed such that:

the edge pieces form side faces extending in the same direction and substantially at right angles to the front piece;

the back pieces form back faces extending inwardly from the respective side faces;

an open channel is formed between each back face and the front piece;

the depth of each channel is substantially the same as the depth of the material to be framed;

the material to be framed is positioned within the frame by positioning a respective outer edge of the material to be framed within the respective channel; and a backing member having a first part and a second part, each part having a first edge and a second edge; and a supporting member comprising a plurality of adjacent, foldably-connected parts, and having a first edge and a second edge;

wherein the first part of the backing member is foldably connected at the first edge thereof to one back piece at the back edge thereof;

a first part of the supporting member is foldably-connected at the first edge of the supporting member to the first part of the backing member at the second edge thereof;

a second part of the supporting member is foldably-connected at the second edge of the supporting member to the second part of the backing member at the first edge thereof;

wherein each of the parts of the supporting member has a bottom edge, and the bottom edge of at least one of the parts of the supporting member is formed so as to provide at least one support point for supporting the picture frame;

wherein each of the first and second parts of the supporting member is generally triangular in shape, the shape and size of the first part of the supporting member are substantially the same as the shape and size of the second part of the supporting member, and the supporting member is generally triangular in shape; and wherein the first and second parts of the backing member have sizes and shapes such that the backing member is foldable to define a size and a shape that are substantially the same size and shape as the surface defined by the back edges of the back pieces extending inwardly.

18. A picture frame as defined in claim 17 wherein each of the first and second parts of the supporting means has a first edge and a second edge, the first edge of the first part of the supporting means is the first edge of the supporting means, and the second edge of the second part of the supporting means is the second edge of the supporting means.

19. A picture frame as defined in claim 18 wherein the first and second edges of the first part of the supporting member are substantially parallel, and the first and second edges of the second part of the supporting member are substantially parallel.

* * * * *